US006694036B2

(12) United States Patent
Makino

(10) Patent No.: US 6,694,036 B2
(45) Date of Patent: Feb. 17, 2004

(54) SPEAKER MOUNTING STRUCTURE

(75) Inventor: Hiroaki Makino, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/050,854

(22) Filed: Jan. 18, 2002

(65) Prior Publication Data

US 2002/0097889 A1 Jul. 25, 2002

(30) Foreign Application Priority Data

Jan. 19, 2001 (JP) ..... 2001-011018

(51) Int. Cl.[7] ..... H04R 25/00
(52) U.S. Cl. ..... 381/389; 381/86
(58) Field of Search ..... 381/86, 302, 389; 296/210, 211, 214; 181/141

(56) References Cited

U.S. PATENT DOCUMENTS 4,418,031 A * 11/1983 Doerer et al. ..... 264/241
RE32,165 E * 6/1986 Gerring ..... 29/401.1
4,828,910 A * 5/1989 Haussling ..... 442/391
5,414,229 A * 5/1995 Rocheleau et al. ..... 181/150
5,699,438 A * 12/1997 Smith et al. ..... 381/386
5,754,664 A * 5/1998 Clark et al. ..... 381/86
5,901,231 A * 5/1999 Parrella et al. ..... 381/86
6,076,885 A * 6/2000 Curtindale et al. ..... 296/214
6,181,797 B1 * 1/2001 Parrella et al. ..... 381/86
6,273,499 B1 * 8/2001 Guyon ..... 296/214
6,318,797 B1 * 11/2001 Bohm et al. ..... 296/210
2001/0012369 A1 * 8/2001 Marquiss ..... 381/86

FOREIGN PATENT DOCUMENTS

JP 8-301021 11/1996

* cited by examiner

*Primary Examiner*—Curtis Kuntz
*Assistant Examiner*—P. Dabney
(74) *Attorney, Agent, or Firm*—Finnegan, Henderson, Farabow, Garrett & Dunner, L.L.P.

(57) ABSTRACT

The present invention provides a speaker mounting structure that takes up less space and affords easier mounting. A mounting component 6 of a speaker 2 is provided to the rear pillar 3 of an automobile 1. A quarter inner panel 7 is provided on the interior IN side of this speaker mounting component 6, and a side body outer panel 8 is provided on the exterior OUT side, leaving a specific gap 9 in between. An extension panel 10 is attached on the exterior side OUT of the quarter inner panel 7. A through-hole 14 is formed in the quarter inner panel 7 and the extension panel 10, and the rear end 12 of the speaker 2 is inserted into the through-hole 14. As a result, the speaker 2 is moved further to the exterior OUT of the cabin, so the trim piece 16 does not protrude as far into the interior IN and rearward visibility is improved.

5 Claims, 6 Drawing Sheets

SPEAKER MOUNTING STRUCTURE

BACKGROUND OF THE INVENTION

I. Field of the Invention

The present invention relates to a speaker mounting structure with which a speaker can fit in a tight space and can be easily installed.

II. Description of the Related Art

FIG. 10 illustrates a rear pillar 51 of an automobile. As shown in FIG. 11, this rear pillar 51 is designed such that a closed cross-section is formed by a quarter inner panel 52 and a side body outer panel 53, and a reinforcement 54 is attached to the exterior side of the quarter inner panel 52. A mounting bracket 56 for a speaker 55 is attached to the interior side of the quarter inner panel 52, and the speaker 55 is attached to the quarter inner panel 52 via the mounting bracket 56. A trim piece 57 is attached to the interior side of the quarter inner panel 52, and a through-hole 57*a* for the speaker 55 is integrally formed in the trim piece 57.

In the past, when an automobile rear speaker was attached to the rear pillar at the very back of the vehicle, the mounting bracket 56 was attached to the interior side of the quarter inner panel 52, and the speaker 55 was installed via this mounting bracket 56. Accordingly, when the speaker 55 was attached to the quarter inner panel 52 surface, the speaker 55 protruded into the interior, which often made the interior feel more cramped and limited rearward visibility through the rear window.

Also, in terms of the sound quality of the speaker 55, because the speaker 55 was installed in such a tight space between the quarter inner panel 52 and the trim piece 57, and this space was not sealed off, the sound quality suffered and sound leakage was also sometimes a problem.

As to the manufacturing cost entailed in installing the speaker 55, since the mounting bracket 56 was used as a separate member in the installation of the speaker 55, it contributed to a higher manufacturing cost.

SUMMARY OF THE INVENTION

The advantages and purposes of the invention will be set forth in part in the description which follows, and in part will be obvious from the description, or may be learned by practice of the invention. Moreover, the advantages and purposes of the invention will be realized and attained by means of the elements and combinations particularly pointed out in the appended claims.

The present invention was conceived in light of the disadvantages of the prior art, and it is an object thereof to provide a speaker mounting structure that does not take up much space and with which a speaker can be attached to its mounting component with ease.

In order to achieve the stated object, with the present invention, a speaker mounting component is provided to a vehicle rear pillar consisting of an inner panel and an outer panel, and a speaker is mounted directly on the inner panel via a fastening component provided to the speaker.

With the present invention, a reinforcing member may be provided on the exterior side of the inner panel, and a through-hole in which the rear end side of the speaker can be inserted may be formed in the inner panel and the reinforcing member.

Also, with the present invention, a trim piece may be provided to the interior side of the inner panel, and an opening may be formed in this trim piece such that, when the speaker is mounted on the speaker mounting component, the fastening component of the speaker is exposed and the speaker is able to pass through. A speaker cover that covers the opening in the trim piece may also be detachably provided to opening.

Further, with the present invention, a cushioning material may be installed on the front surface of the speaker, while a lip that hits this reinforcing member and reinforcing walls that reinforce said lip may be formed on the speaker cover. Also, a shielding member that seals off the space in which the rear end of the speaker is inserted may be provided between the inner panel and outer panel that make up part of the rear pillar It is to be understood that both the foregoing general description and the following detailed description are only exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Reference will now be made in detail to the present preferred embodiments of the invention illustrated in the accompanying drawings. Wherever possible, the same reference numbers are used throughout the drawings to refer to the same or like parts.

Figure 1:
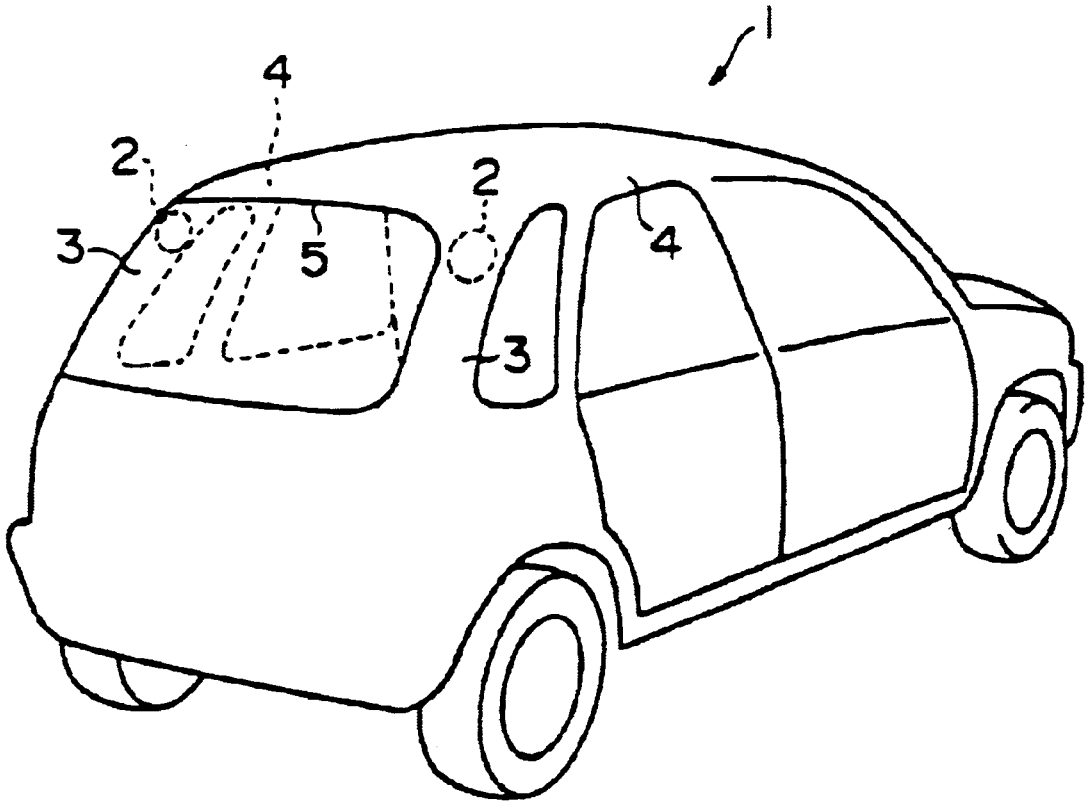
FIG. 1 is a perspective view from the rear of an automobile that employs the speaker mounting structure pertaining to an embodiment of the present invention.
Figure 2:
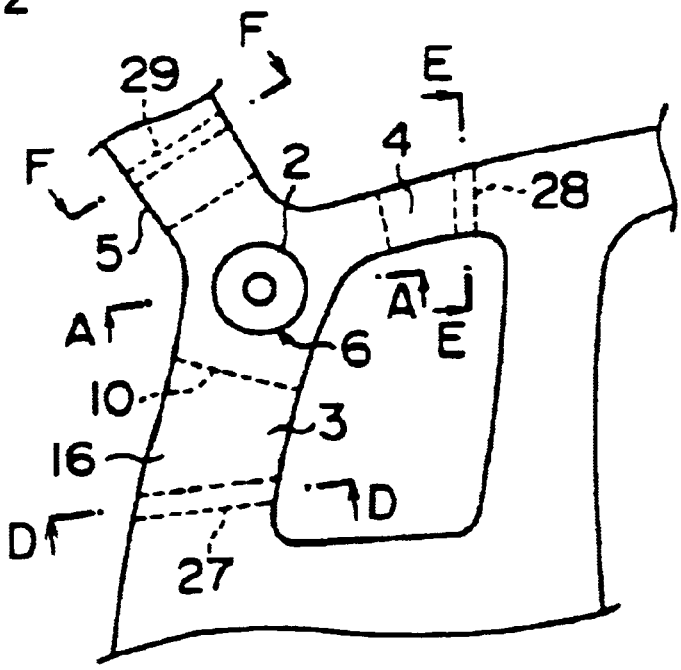
FIG. 2 is a front view, seen from the interior, of a speaker mounting component disposed at the left rear pillar of the automobile in FIG. 1.

FIG. 1 shows an automobile 1 in rear three-quarter view. The automobile 1 is equipped with speakers 2 that produce sound from an audio device such as a car radio or a car stereo, which are installed in right and left rear pillars 3 provided at the very back of the vehicle. FIG. 2 shows the mounting location of the speaker 2 installed on the left side of the vehicle. As shown in the drawings, the speakers 2 are mounted at the upper part of the rear pillars 3, near the place where these rear pillars 3 meet the side body 4 and the rear roof rail 5.

Figure 3:
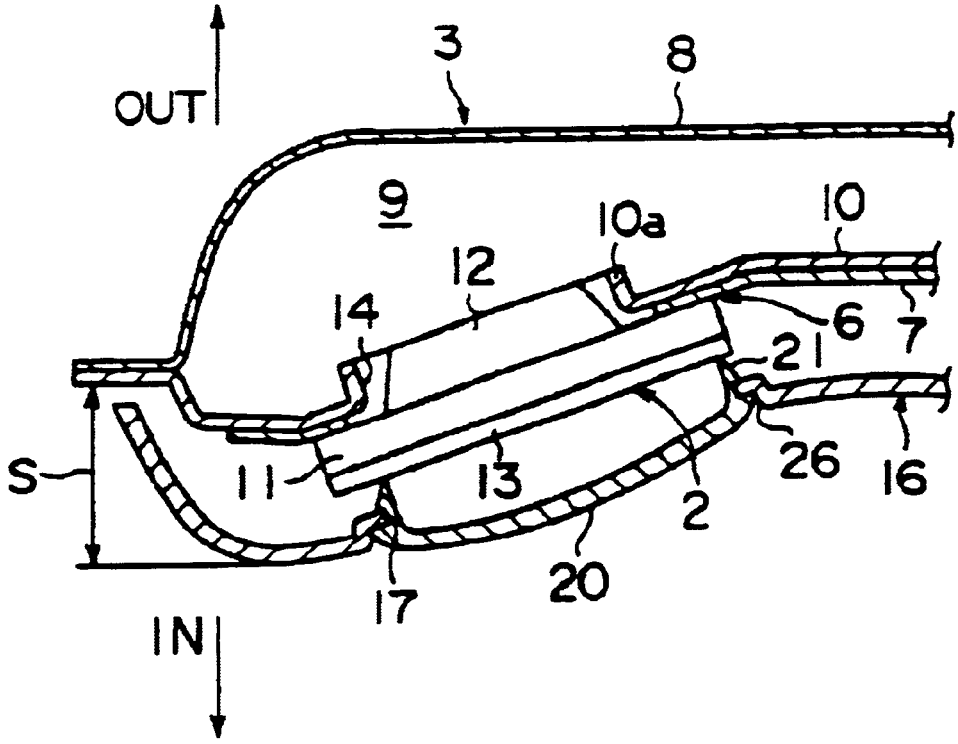
FIG. 3 is a cross section along the lines A—A in FIG. 2.
Figure 4:
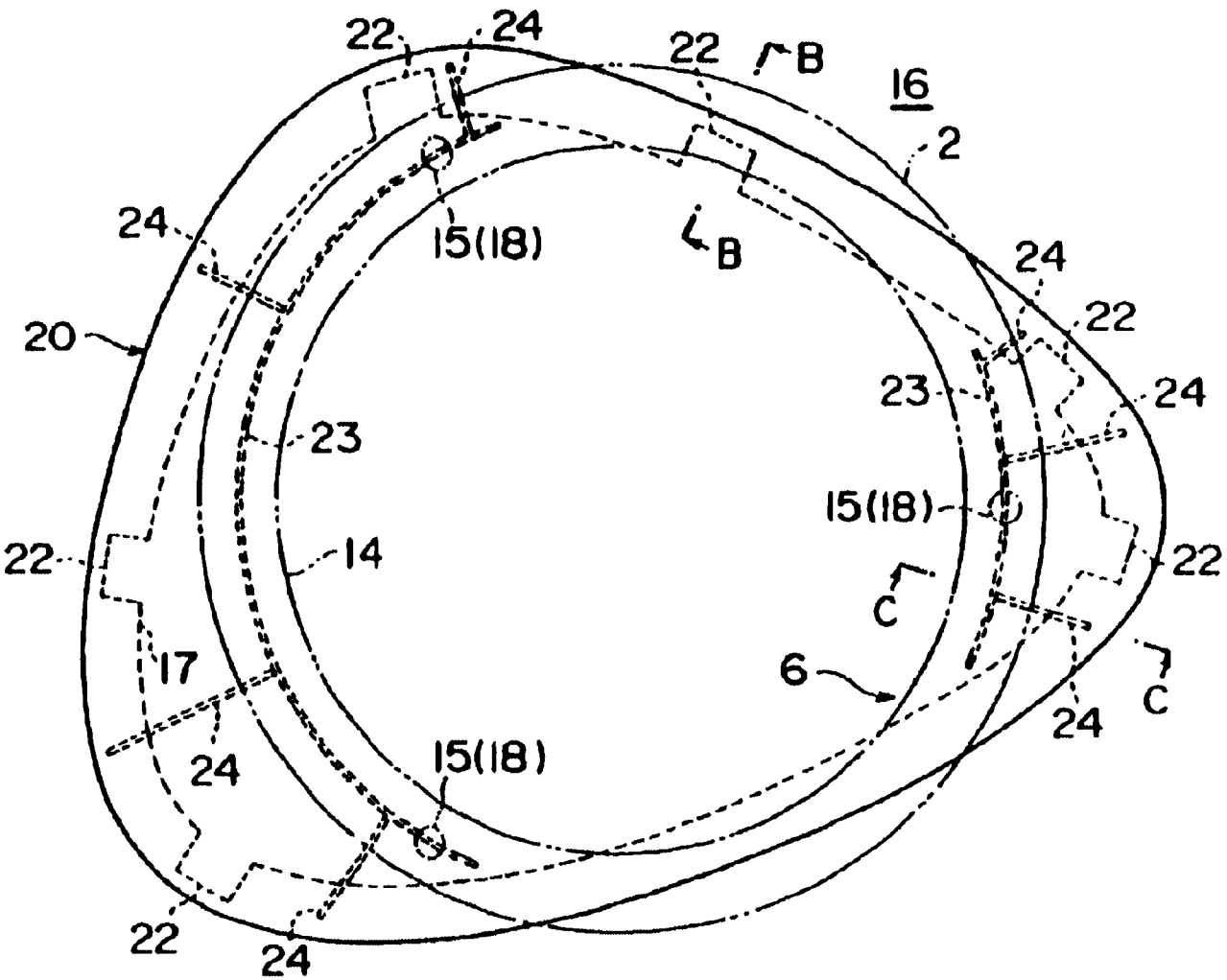
FIG. 4 is a front view of a speaker cover attached to the speaker mounting component in FIG. 2.
Figure 5:
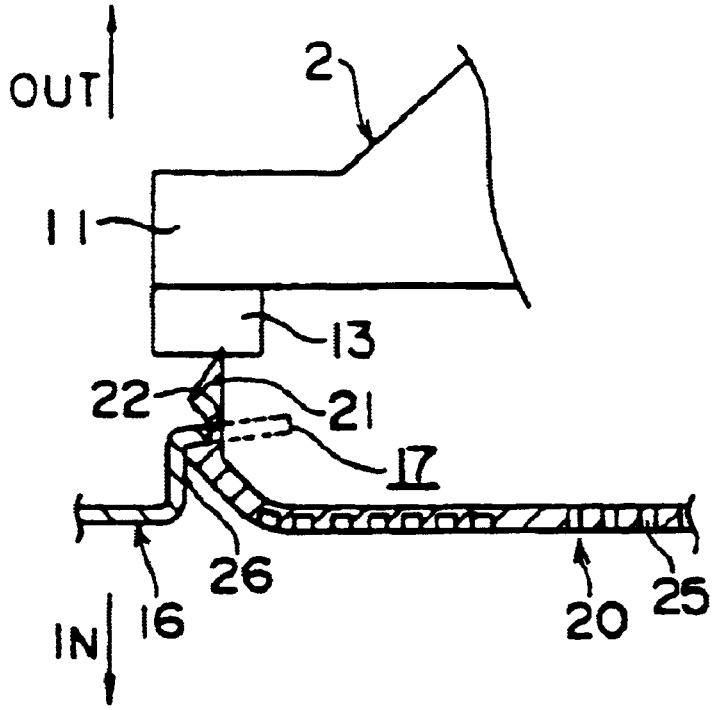
FIG. 5 is a cross-sectional view along the lines B—B in FIG. 4.
Figure 6:
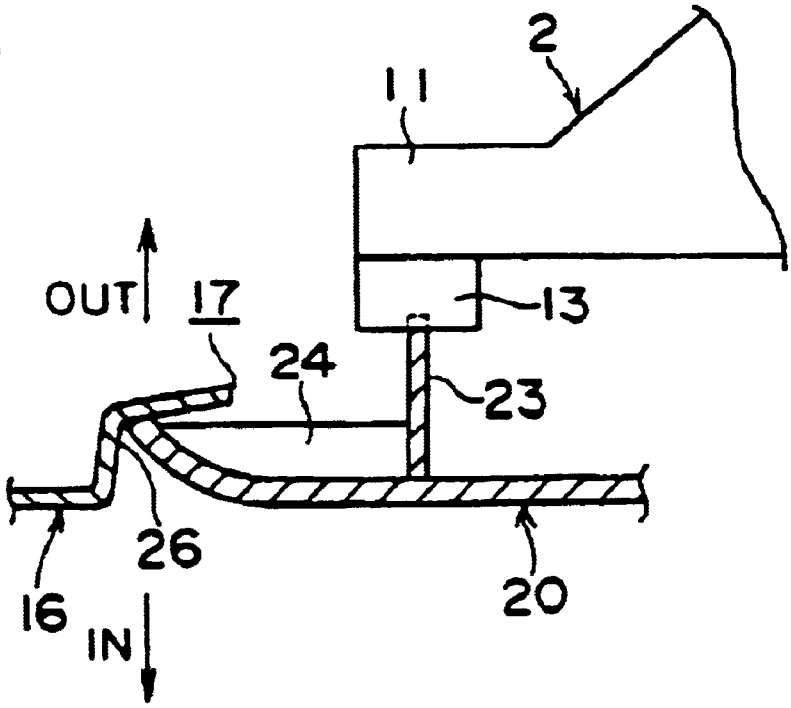
FIG. 6 is a cross-sectional view along the lines C—C in FIG. 4.

FIG. 3 is a cross-sectional view of the mounting component 6 for each speaker 2. The speaker 2 consists of a large-diameter housing 11 provided on the front side of the speaker 2, and a rear portion 12 where coils, magnets or the like are disposed. In this embodiment, the speakers are circular in shape. Also, as shown in FIG. 4, three fixing holes 15 for mounting the speaker 2 are provided equally spaced around the outer periphery of the housing 11. As shown in FIGS. 5 and 6, an annular cushioning material 13 made of a sponge or the like is attached to the interior side around the outer periphery of the speaker 2.

A quarter inner panel 7 is provided on the interior side of this speaker mounting component 6, and a side body outer panel 8 is provided on the exterior side, leaving a specific gap 9 in between. A rear pillar upper extension (hereinafter referred to as extension panel) 10 is attached on the exterior side of the quarter inner panel 7, and the extension panel 10 is formed so that it branches in the three directions of the rear pillar 3, the side body 4, and the rear roof rail 5.

A circular through-hole 14 that is smaller in diameter than the housing 11 of the speaker 2 and in which the rear part of the speaker 2 can be inserted is formed in the extension panel 10 and the quarter inner panel 7 located at the speaker mounting component 6. As shown in FIG. 4, fixing holes 18 for fixing the speaker 2 to the speaker mounting component 6 and corresponding to the fixing holes 15 in the speaker 2 are formed around the periphery of the through-hole 14. An annular flange 10*a* protruding on the exterior side is formed corresponding to the through-hole 14 in one of the extension panels 10.

A plastic trim piece 16 is mounted on the interior side of the quarter inner panel 7, and an opening 17 corresponding to the location of the through-hole 14 is formed in the trim piece 16. The opening 17 is non-circular and substantially triangular in shape, and is formed so that the fixing holes 15 and 18 used to attach the speaker 2 are exposed within the opening 17. The opening 17 is also formed in a shape such that the longest perpendicular of the triangular shape is longer than the diameter of the speaker 2 so that the speaker 2 can pass through this opening 17, while the other perpendiculars are shorter than this diameter. This opening 17 does not necessarily have to be triangular in shape, though, and what is important is that the fixing holes 15 can be seen when the speaker 2 has been installed, there is a portion larger than the diameter of the speaker 2 at opposing locations of a part of the opening 17, and the speaker 2 can be passed through the opening 17 at this place.

The solid line in FIG. 4 indicates the external shape of a speaker cover 20 that covers the opening 17 in the trim piece 16. The external shape of the speaker cover 20 approximates but is slightly larger than the opening 17. Tabs 21 for mounting the speaker cover 20 are formed at six places on the back around the periphery, as shown in FIG. 5. Notches 22 extending to the outside of the opening 17 are formed at six places around the opening 17 of the trim piece 16, and the tabs 21 of the speaker cover 20 fit into these notches 22. A rib 23 is formed on the back of the speaker cover 20, corresponding to the portion where the outer periphery of the speaker 2 is exposed within the opening 17 of the trim piece 16. The rib 23 protrudes from the back of the speaker cover 20 so that the distal end thereof will come into contact with the cushioning material 13. Walls 24 extending radially to the outside and toward the outer periphery of the speaker cover 20 from the lateral surface of the rib 23 are formed on the rib 23. Numerous passage holes 25 that carry sound to the interior are made in the center part of the speaker cover 20.

A step 26 that protrudes toward the quarter inner panel 7 side is provided to the opening 17 in the trim piece 16, and is formed such that the trim piece 16 and the speaker cover 20 lie in substantially the same plane when the speaker cover 20 is installed in the opening 17.

Figure 7:
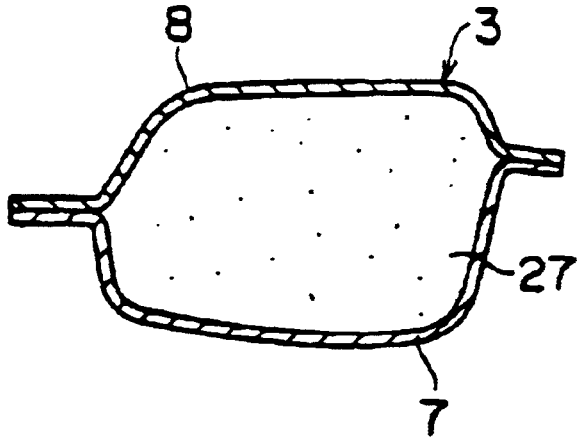
FIG. 7 is a cross-sectional view along the lines D—D in FIG. 2.
Figure 8:
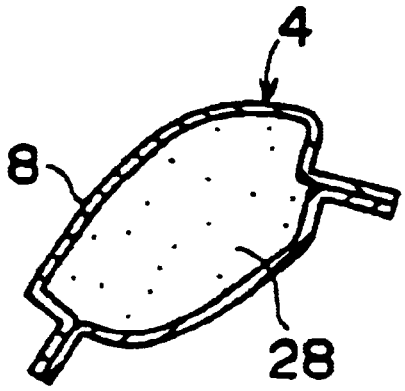
FIG. 8 is a cross-sectional view along the lines E—E in FIG. 2.
Figure 9:
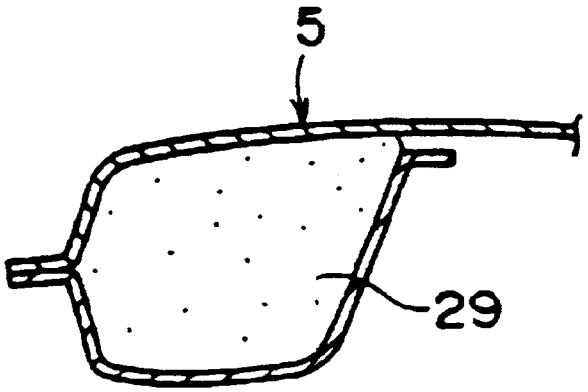
FIG. 9 is a cross-sectional view along the lines F—F in FIG. 2.
Figure 10:
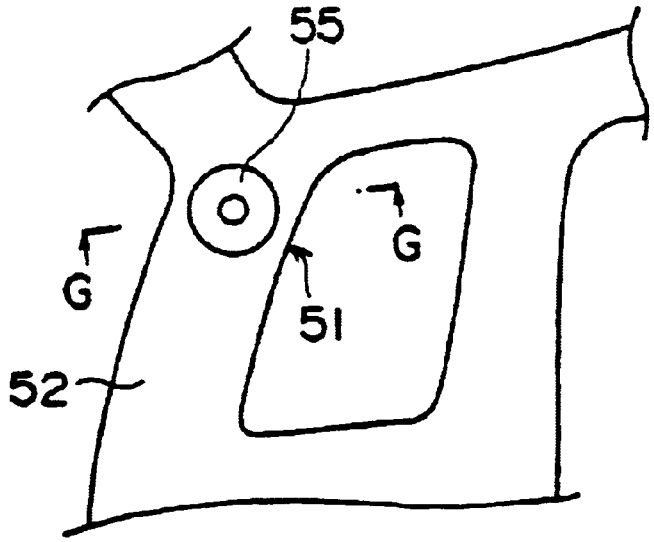
Fig. 10 PRIOR ART
FIG. 10 is a front view, seen from the interior, of a conventional speaker mounting component disposed at the rear pillar of an automobile.
Figure 11:
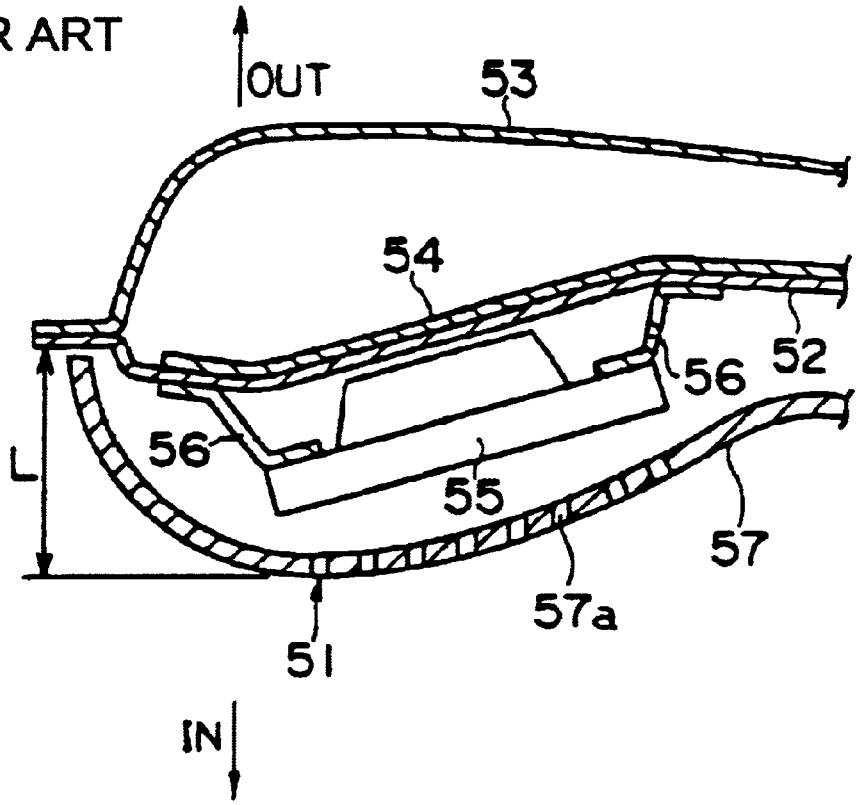
Fig. 11 PRIOR ART
FIG. 11 is a cross-sectional view along the lines G—G in FIG. 10.

The rear pillar 3, side body 4, and rear roof rail 5 shown in FIG. 2 have closed cross sections as shown in FIGS. 7 to 9, respectively, and foam materials 27 to 29 are provided to each so that a gap 9 on the rear end 12 side of the speaker 2 is sealed off.

The structure is as described above in this embodiment, so the speaker 2 can be attached to the speaker mounting component 6 not only before the trim piece 16 is attached, but even after the trim piece 16 is attached. Specifically, since part of the opening 17 (the portion having the longest perpendicular in the substantially triangular shape) in the trim piece 16 is formed larger than the diameter of the speaker 2, the rear end 12 of the speaker 2 is inserted into the through-hole 14 so that the housing 11, which is the largest-diameter part of the speaker 2, passes through this opening 17, and the fixing holes 15 in the speaker 2 are aligned with the fixing holes 18 formed on the quarter inner panel 7 side. Since the fixing holes 15 can be seen inside the opening 17 at this point, the installer can easily attach the speaker 2 to the quarter inner panel 7 using screws or the like.

After the speaker 2 has been installed, the tabs 21 of the speaker cover 20 are snapped into the notches 22 of the opening 17 to mount the speaker cover 20 in the opening 17.

When the speaker cover 20 is to be removed, a screwdriver or other such tool is inserted at locations corresponding to the notches 22 of the opening 17, the tabs 21 are pushed to the inside of the opening 17 and pried open, and the speaker cover 20 is taken out of the opening 17.

Thus, in this embodiment, when the speaker 2 is being installed or removed, the speaker 2 can be placed in the speaker mounting component 6 without removing the trim piece 16, and because the fixing holes 15 of the speaker 2 can be seen through the opening 17, the screws are easy to install and remove.

After the speaker 2 has been fixed, the rear end 12 of the speaker 2 can be passed through the through-hole 14 so that the speaker 2 will be on the outside of the cabin to the extent that it has been thus inserted, which reduces the protrusion amount S that the trim piece 16 protrudes into the interior of the cabin. Therefore, the conventional protrusion amount L shown in FIG. 1 can be reduced, affording greater rearward visibility. Furthermore, the rigidity of the speaker cover 20 is greater because the rib 23 and the walls 24 are formed on the speaker cover 20.

Since the cushioning material 13 is provided to the speaker 2, bringing the rib 23 of the speaker cover 20 into contact with the cushioning material 13 prevents sound from leaking into the gap between the trim piece 16 and the quarter inner panel 7, and prevents juddering and other such noise.

Because the gap 9 in which the rear end 12 of the speaker 2 is installed is sealed off by the foam materials 27 to 29, this sealed off space serves as a speaker box and enhances the sound quality, and sound leakage is also prevented. The foam materials 27 to 29 also prevent noise coming in from outside the cabin.

If the trim piece has no speaker cover 20, then mesh-like air holes must be made during the formation of the trim piece to allow the speaker sound to travel, but because the speaker cover 20 is formed as a separate part with the passage holes 25 formed therein, it is easier to form the trim piece 16.

Other embodiments of the invention will be apparent to those skilled in the art from consideration of the specification and practice of the invention disclosed herein. It is intended that the specification and examples be considered as exemplary only. Thus, it should be understood that the invention is not limited to the illustrative examples in this specification. Rather, the invention is intended to cover all modifications and variations that come within the scope of the following claims and their equivalents.

For example, as discussed above, in the embodiment of the present invention, a speaker mounting component is provided to a vehicle rear pillar consisting of an inner panel and an outer panel, and a speaker is mounted directly on the inner panel via a fastening component provided to the speaker, so the speaker can be mounted without using a bracket as in the past, which decreases the number of parts required and lowers the overall cost.

Moreover, if a reinforcing member is provided on the exterior side of the inner panel, a through-hole in which the rear end side of the speaker can be inserted is formed in the inner panel and the reinforcing member. Then the location where the speaker is mounted can be moved further outside of the cabin than in the past, providing more space in the cabin and greater rearward visibility.

Also, if a decorating material is provided to the interior side of the inner panel, and an opening is formed in this trim piece such that, when the speaker is mounted on the speaker mounting component, the fastening component of the speaker is exposed and the speaker is able to pass through, then the fastening component can be seen during the fixing of the speaker, which facilitates the installation and removal of the speaker.

The present invention improves the appearance of the speaker mounting component and makes it easier to form the trim piece by detachably providing the opening in the decorating material with a speaker cover that covers this opening.

Additionally, if a cushioning material is installed on the front surface of the speaker, while a lip that abuts on this cushioning material and reinforcing walls that reinforce said lip are formed on the speaker cover, then the rigidity of the speaker cover can be increased and sound can be prevented from leaking from the speaker.

Finally, with the present invention, the speaker sound can be improved and sound leakage to the outside can be prevented by providing a shielding member that seals off the space in which the rear end of the speaker is inserted, between the inner panel and outer panel that make up the rear pillar

What is claimed is:

1. A speaker mounting structure, comprising:

a speaker mounting component supported by a vehicle rear pillar having an inner panel and an outer panel, the rear pillar being connected to a vehicle side body and a rear roof rail, the inner panel comprising a quarter inner panel provided on an interior side of the speaker mounting component and the outer panel comprising a side body outer panel provided on an exterior side of the speaker mounting component so as to form a gap between the quarter inner panel and the side body outer panel;

a speaker mounted by a fastening component supported by the speaker at an upper part of the rear pillar adjacent to the connection between the rear pillar, the side body, and the rear roof rail, the speaker having a housing provided on a front side of the speaker, a rear portion supporting the fastening component and having a diameter less than a diameter of the speaker housing, and a plurality of speaker mounting holes provided around an outer periphery of the speaker housing; and an extension panel provided on an exterior side of the inner panel so as to branch in three directions towards the rear pillar, the side body, and the rear roof rail, the extension panel having an annular flange forming a through-hole having a diameter less than the diameter of the speaker housing so as to receive the rear portion of the speaker within a periphery of the annular flange, and a plurality of panel mounting holes provided around a periphery of the through-hole so as to be aligned with the plurality of speaker mounting holes provided around the outer periphery of the speaker housing.

2. The speaker mounting structure according to claim 1, wherein a trim piece is provided on an interior side of the inner panel, and an opening is formed in the trim piece such that, when the speaker is mounted on the speaker mounting component, the fastening component of the speaker is exposed and the speaker is able to pass through the opening.

3. The speaker mounting structure according to claim 2, further comprising a speaker cover shaped to cover the opening formed in the decorating material, and arranged to be detachable from the opening.

4. The speaker mounting structure according to claim 3, further comprising a cushioning material arranged on a front surface of the speaker, a rib abutting the cushioning material, and reinforcing walls formed on the speaker cover so as to reinforce the rib.

5. The speaker mounting structure according to claim 4, further comprising a shielding member provided between the inner and outer panels of the rear pillar, and shaped to seal off a space in which the rear end of the speaker is inserted.

* * * * *